US008683701B1

(12) United States Patent
Loftin

(10) Patent No.: US 8,683,701 B1
(45) Date of Patent: Apr. 1, 2014

(54) VIBRATING RAZOR HANDLE ASSEMBLY

(76) Inventor: Jonathan L. Loftin, Tulsa, OK (US)

( * ) Notice: Subject to any disclaimer, the term of this patent is extended or adjusted under 35 U.S.C. 154(b) by 142 days.

(21) Appl. No.: 13/370,482

(22) Filed: Feb. 10, 2012

(51) Int. Cl.
*B26B 19/28* (2006.01)
*B26B 19/38* (2006.01)

(52) U.S. Cl.
USPC ..... 30/45; 30/44; 30/526; 30/541; 34/202; 250/455.11

(58) Field of Classification Search
USPC ..... 30/34.05, 42, 44, 45, 526, 53, 541, 8; 34/202; 250/455.11
See application file for complete search history.

(56) References Cited

U.S. PATENT DOCUMENTS

| | | | | | |
|---|---|---|---|---|---|
| 2,587,131 | A * | 2/1952 | Ficken | 250/455.11 |
| 3,955,922 | A * | 5/1976 | Moulthrop | 422/300 |
| 4,642,892 | A * | 2/1987 | Ishida | 30/44 |
| 4,819,330 | A * | 4/1989 | Fenn et al. | 30/45 |
| 5,007,169 | A | 4/1991 | Motta | |
| 5,046,249 | A * | 9/1991 | Kawara et al. | 30/45 |
| 5,214,851 | A * | 6/1993 | Althaus | 30/45 |
| 5,299,354 | A * | 4/1994 | Metcalf et al. | 30/45 |
| 5,487,877 | A | 1/1996 | Choi | |
| 6,026,577 | A | 2/2000 | Ferraro | |
| 6,105,252 | A * | 8/2000 | Andis | 30/45 |
| D437,661 | S | 2/2001 | Pinchuk | |
| 6,378,210 | B1 * | 4/2002 | Bickford | 30/43.92 |
| 7,225,559 | B1 * | 6/2007 | Padilla | 34/202 |
| 7,654,003 | B2 * | 2/2010 | Simms et al. | 30/34.05 |
| 7,810,240 | B2 | 10/2010 | Lee et al. | |
| 8,141,253 | B2 * | 3/2012 | Royle | 30/34.05 |
| 2008/0034589 | A1 * | 2/2008 | Nearing | 30/32 |
| 2008/0168677 | A1 * | 7/2008 | Miller | 34/202 |
| 2009/0199406 | A1 * | 8/2009 | Gratsias et al. | 30/45 |
| 2011/0099831 | A1 | 5/2011 | Parisi et al. | |

* cited by examiner

*Primary Examiner* — Hwei C Payer

(57) ABSTRACT

A vibrating razor handle assembly is provided for facilitating use of different types of razor blade cartridges with a single vibrating handle. The assembly includes an elongated housing having a first end, a second end, and a perimeter wall extending between the first end and the second end. A vibrator is positioned in the housing. An adapter is coupled to the housing and the vibrator whereby the adapter vibrates when the vibrator is activated. The adapter has a distal end relative to the housing configured for coupling to a razor blade cartridge.

22 Claims, 4 Drawing Sheets

VIBRATING RAZOR HANDLE ASSEMBLY

BACKGROUND OF THE DISCLOSURE

Field of the Disclosure

The disclosure relates to razor devices and more particularly pertains to a new razor device for facilitating use of different types of razor blade cartridges with a single vibrating handle.

SUMMARY OF THE DISCLOSURE

An embodiment of the disclosure meets the needs presented above by generally comprising an elongated housing having a first end, a second end, and a perimeter wall extending between the first end and the second end. A vibrator is positioned in the housing. An adapter is coupled to the housing and the vibrator whereby the adapter vibrates when the vibrator is activated. The adapter has a distal end relative to the housing configured for coupling to a razor blade cartridge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
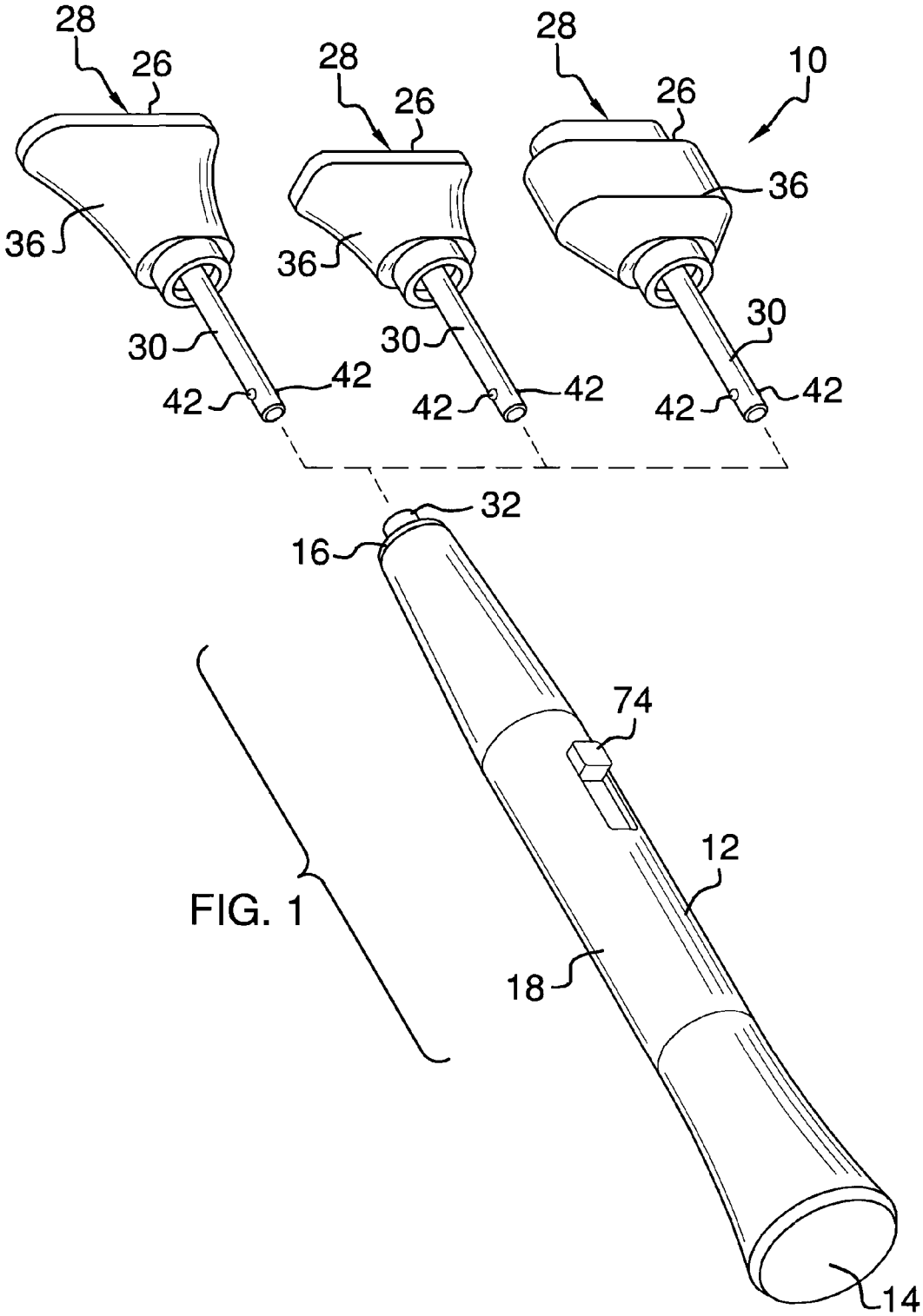
FIG. 1 is a partially exploded top front side perspective view of a vibrating razor handle assembly according to an embodiment of the disclosure.
Figure 2:
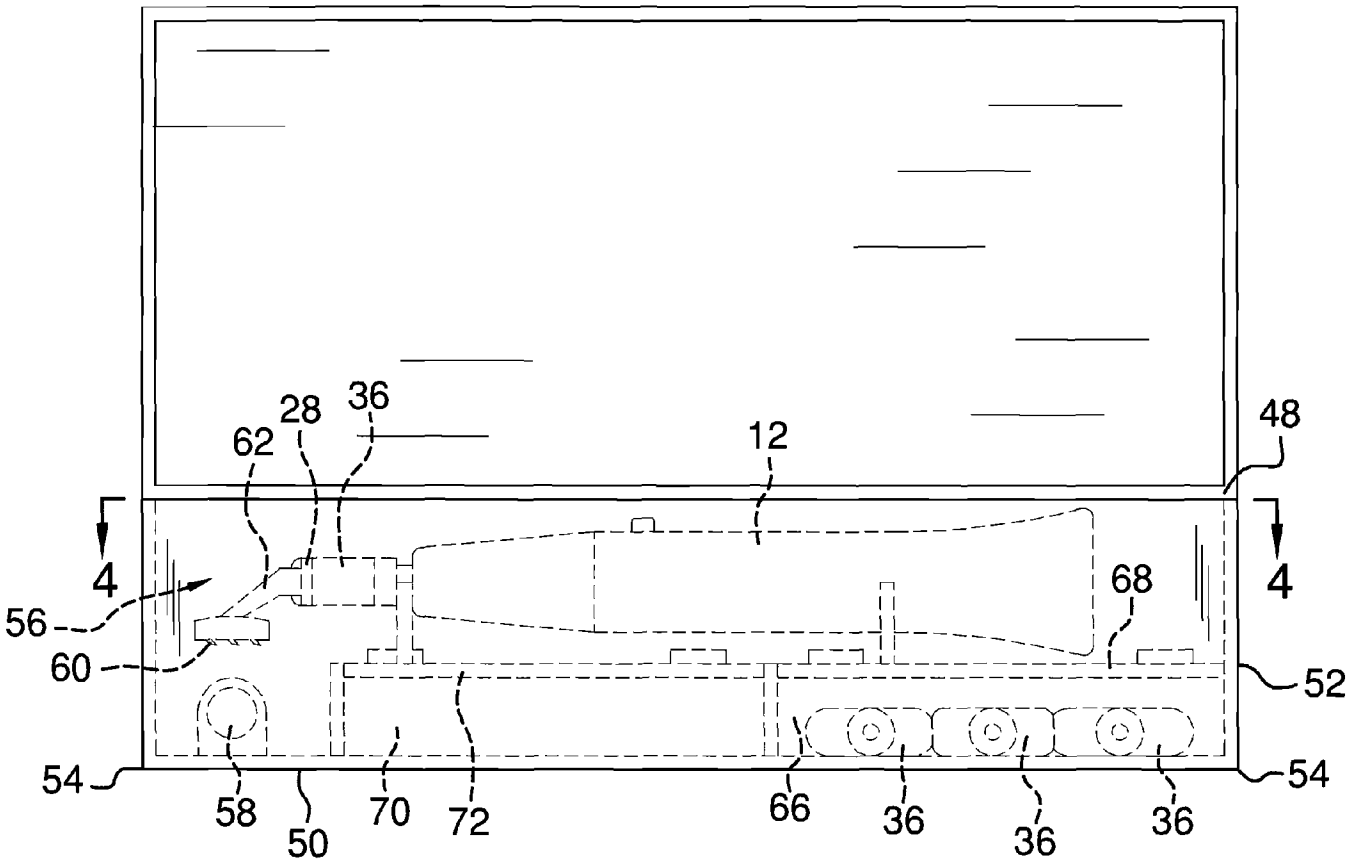
FIG. 2 is a side view of an embodiment of the disclosure.
Figure 3:
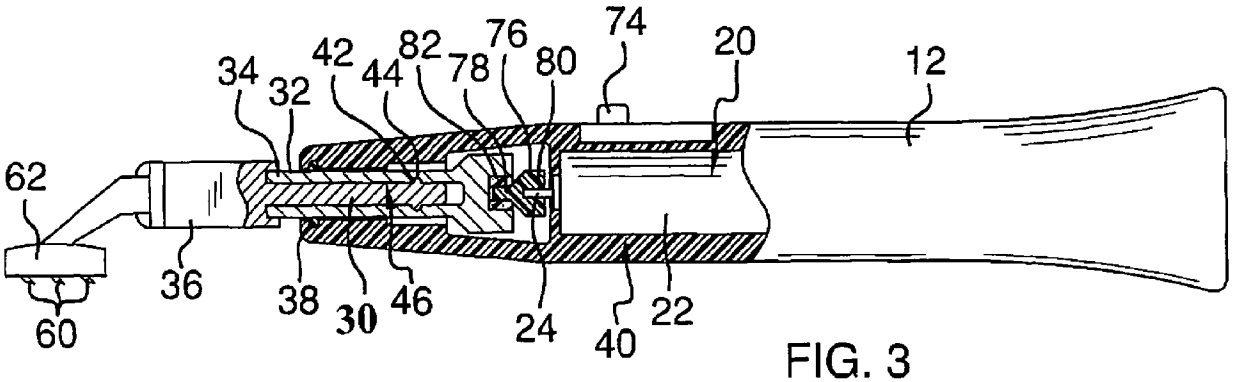
FIG. 3 is a partial cut-away front view of an embodiment of the disclosure.
Figure 4:
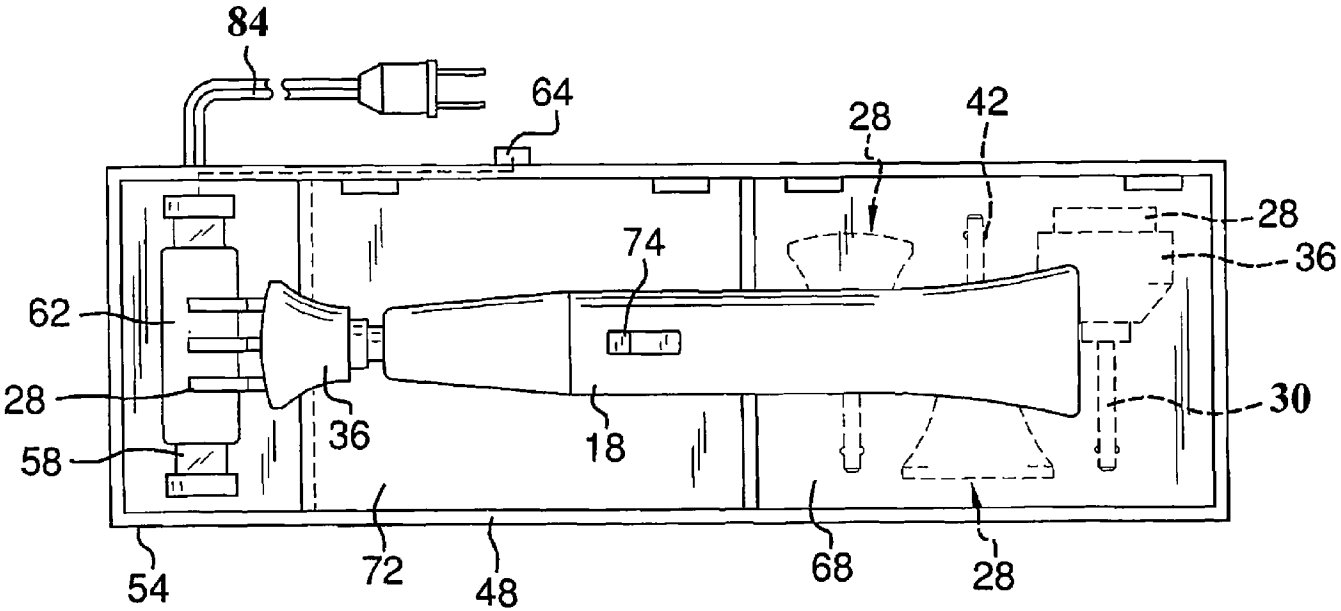
FIG. 4 is a cross-sectional view of an embodiment of the disclosure taken along line 4-4 of FIG. 2.
Figure 5:
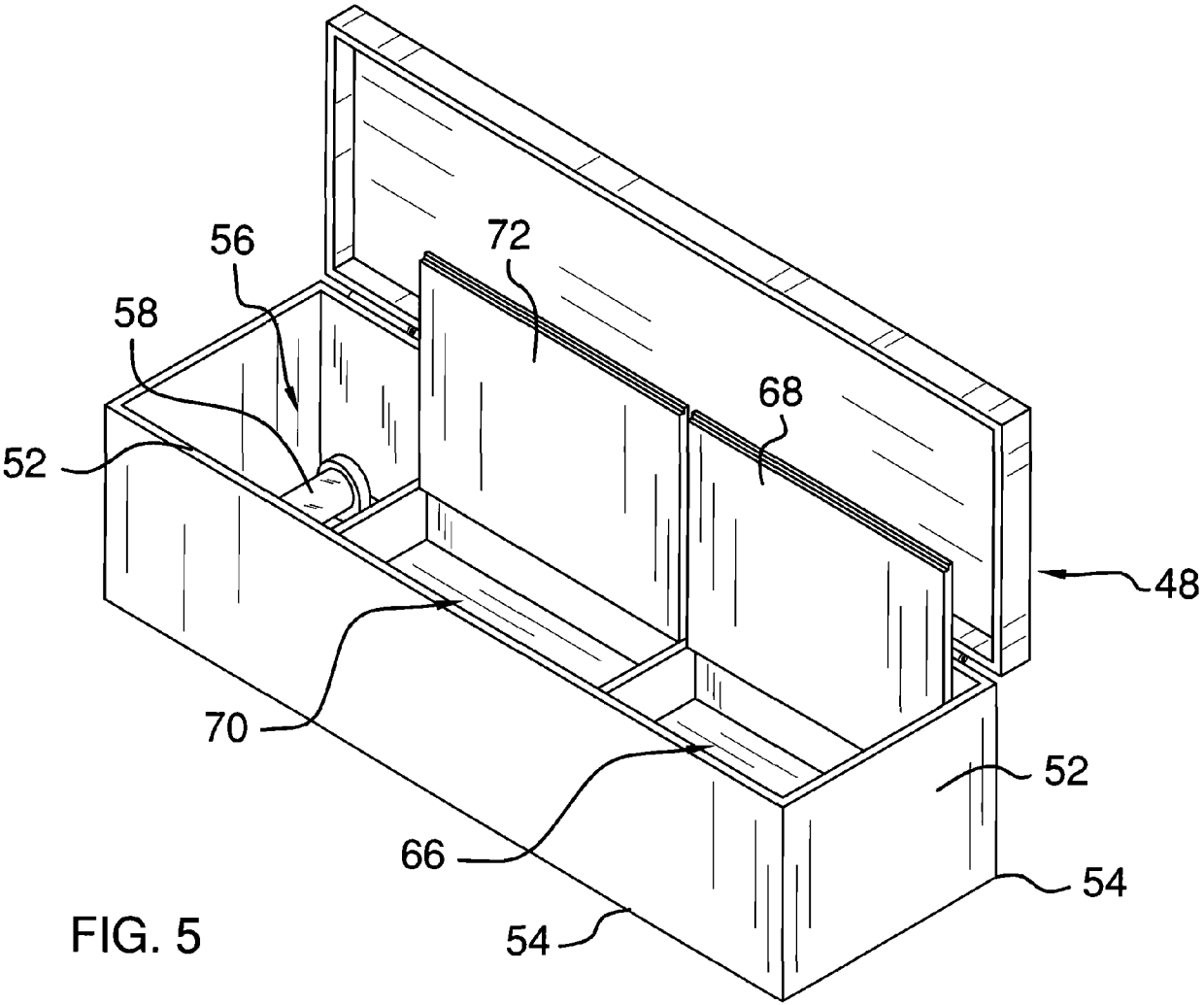
FIG. 5 is a top front side perspective view of a storage unit of an embodiment of the disclosure.

With reference now to the drawings, and in particular to FIGS. 1 through 5 thereof, a new razor device embodying the principles and concepts of an embodiment of the disclosure and generally designated by the reference numeral 10 will be described.

As best illustrated in FIGS. 1 through 5, the vibrating razor handle assembly 10 generally comprises an elongated housing 12 having a first end 14, a second end 16, and a perimeter wall 18 extending between the first end 14 and the second end 16. A vibrator 20 is positioned in the housing 12. The vibrator 20 has a motor 22 and a shaft 24 operationally coupled to and extending from the motor 22. The shaft 24 is positioned in the housing 12. A plurality of adapters 36 is provided. Each adapter 36 is selectively and interchangeably couplable to the housing 12 and the vibrator 20. Thus, the selected adapter 36 vibrates when the vibrator 20 is activated. Each adapter 36 has a distal end 26 relative to the housing 12. The distal end 26 of each adapter 36 is configured for coupling to a razor blade cartridge 62. The distal end 26 of each adapter 36 is further uniquely configured for coupling to one of a plurality of different razor blade cartridge connectors 28.

A socket 32 is coupled to the housing 12. The socket 32 has a first end 34 coupled to a selectable one of the adapters 36. Each adapter 36 has a rod 30 inserted into the socket 32 coupling the adapter 36 to the socket 32. A seal 38 is coupled between the socket 32 and the housing 12 to prevent liquids from entering an interior 40 of the housing 12 and interfering with the motor 22. A projection 42 is coupled to and extends outwardly from the rod 30 of the adapter 36. Multiple such projections 42 may be provided to secure the rod 30 relative to the socket 32. An indentation 44 extends into an interior wall 46 of the socket 32. The indentation 44 receives the projection 42 when the rod 30 of the adapter 36 is inserted into the socket 32. The projection 42 may be complimentary in shape to the indentation 44.

A storage unit 48 has a bottom 50 and a sidewall 52 extending upwardly from a perimeter edge 54 of the bottom 50 defining an interior space 56. An ultraviolet light source 58 is coupled to and positioned in the interior space 56 of the storage unit 48. The housing 12 is positionable in the interior space 48 such that the ultraviolet light source 58 is configured for positioning adjacent to a razor blade 60 of a razor blade cartridge 62. A light switch 64 is coupled to the storage unit 48 and operationally coupled to the ultraviolet light source 58 for selectively activating the ultraviolet light source 58. A power cord 84 may be operationally coupled to the light switch 64 and the ultraviolet light source 58. A first compartment 66 is positioned in the interior space 56. The adapters 36 are positionable in the first compartment 66 for storage. A first lid 68 is pivotally coupled to the storage unit 48 and positioned for selectively covering the first storage compartment 66. A second compartment 70 is positioned in the interior space 56 adjacent to the first compartment 66 and may be used for storage of other shaving items. The first compartment 66 and second compartment 70 may form a base for supporting the handle 12 in the interior space 56 of the storage unit 48. A second lid 72 is coupled to the storage unit 48 and positioned in the interior space 56 for selectively covering the second storage compartment 70.

A vibrator switch 74 is coupled to the housing 12. The vibrator switch 74 is operationally coupled to the vibrator 20 for selectively activating the vibrator 20. The vibrator switch 74 may also be operationally coupled to the vibrator 20 for adjusting a vibration speed of the vibrator 20. A dampener 76 has a first end 78 engaging the socket 32 and a second end 80 receiving the shaft 24 of the vibrator 20. A gasket 82 may also be coupled to the socket 32. The gasket 82 is positioned between the dampener 76 and the socket 32.

In use, the appropriate adapter 36 is selected to fit the razor blade cartridge connector 28 for the desired type of razor blade cartridge 62 to be used. The rod 30 of the adapter 36 is inserted into the socket 32 and the razor blade cartridge 62 is coupled to the adapter 36. The vibrator 20 may be activated to vibrate the razor blade 60 while shaving. After shaving, the handle 12 and attached razor blade 60 may be placed into the storage unit 48 positioning the razor blade 60 adjacent to the ultraviolet light source 58 to sanitize the razor blade 60 between uses. When desired, a different brand or type of razor blade cartridge 62 may be used by removing an old adapter 36 then selecting and installing the appropriate new adapter 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A razor system comprising:

a vibrating razor handle assembly comprising:

an elongated housing having a first end, a second end, and a perimeter wall extending between said first end and said second end;

a vibrator positioned in said housing, said vibrator having a motor and a shaft operationally coupled to and extending from said motor, said shaft being positioned in said housing;

an adapter coupled to said housing, said adapter being coupled to said vibrator whereby said adapter vibrates when said vibrator is activated, said adapter having a distal end relative to said housing, said distal end of said adapter being configured for coupling to a razor blade cartridge;

a socket coupled to said housing, said socket having a first end coupled to said adapter, said adapter having a rod inserted into said socket whereby said adapter is coupled to said socket;

a projection coupled to and extending outwardly from said rod of said adapter; and an indentation extending into an interior wall of said socket, said indentation receiving said projection when said rod of said adapter is inserted into said socket.

2. The system of claim 1, further including said projection being complimentary to said indentation.

3. The system of claim 1, further comprising:

a storage unit having a bottom and a sidewall extending upwardly from a perimeter edge of said bottom defining an interior space; and an ultraviolet light source coupled to and positioned in said interior space of said storage unit, said housing being positionable in said interior space whereby said ultraviolet light is configured for positioning adjacent to a razor blade of the razor blade cartridge.

4. The system of claim 3, further including a light switch coupled to said storage unit, said light switch being operationally coupled to said ultraviolet light source for selectively activating said ultraviolet light source.

5. The system of claim 1, further including a plurality of said adapters, each said adapter being interchangeably couplable to said housing.

6. The system of claim 5, further comprising said distal end of each adapter being uniquely configured for coupling to one of a plurality of different razor blade cartridge connectors.

7. The system of claim 6, further comprising:

a storage unit having a bottom and a sidewall extending upwardly from a perimeter edge of said bottom defining an interior space; and a compartment positioned in said interior space, said plurality of adapters being positionable in said compartment.

8. The system of claim 1, said assembly further including a vibrator switch coupled to said housing, said vibrator switch being operationally coupled to said vibrator for selectively activating said vibrator.

9. The system of claim 8, further including said vibrator switch being operationally coupled to said vibrator for adjusting a vibration speed of said vibrator.

10. The system of claim 1, said assembly further including a seal coupled between said socket and said housing.

11. A razor system comprising:

a vibrating razor handle assembly comprising:

an elongated housing having a first end, a second end, and a perimeter wall extending between said first end and said second end;

a vibrator positioned in said housing, said vibrator having a motor and a shaft operationally coupled to and extending from said motor, said shaft being positioned in said housing;

an adapter coupled to said housing, said adapter being coupled to said vibrator whereby said adapter vibrates when said vibrator is activated, said adapter having a distal end relative to said housing, said distal end of said adapter being configured for coupling to a razor blade cartridge;

a socket coupled to said housing, said socket having a first end coupled to said adapter; and a dampener having a first end engaging said socket and a second end receiving said shaft of said vibrator.

12. The system of claim 11, further including a gasket coupled to said socket, said gasket being positioned between said dampener and said socket.

13. The system of claim 11, further comprising a vibrator switch coupled to said housing, said vibrator switch being operationally coupled to said vibrator for selectively activating said vibrator.

14. The system of claim 13, further including said vibrator switch being operationally coupled to said vibrator for adjusting a vibration speed of said vibrator.

15. The system of claim 11, further including a plurality of said adapters, each said adapter being interchangeably couplable to said housing.

16. The system of claim 15, further comprising said distal end of each adapter being uniquely configured for coupling to one of a plurality of different razor blade cartridge connectors.

17. The system of claim 16, further comprising:

a storage unit having a bottom and a sidewall extending upwardly from a perimeter edge of said bottom defining an interior space; and a compartment positioned in said interior space, said plurality of adapters being positionable in said compartment.

18. The system of claim 11, further comprising:

a storage unit having a bottom and a sidewall extending upwardly from a perimeter edge of said bottom defining an interior space; and an ultraviolet light source coupled to and positioned in said interior space of said storage unit, said housing being positionable in said interior space whereby said ultraviolet light is configured for positioning adjacent to a razor blade of the razor blade cartridge.

19. The system of claim 18, further including a light switch coupled to said storage unit, said light switch being operationally coupled to said ultraviolet light source for selectively activating said ultraviolet light source.

20. The system of claim 11, further including said adapter having a rod inserted into said socket whereby said adapter is coupled to said socket.

21. The system of claim 11, further including a seal coupled between said socket and said housing.

22. A razor system comprising:

a vibrating razor handle assembly comprising:

an elongated housing having a first end, a second end, and a perimeter wall extending between said first end and said second end;

a vibrator positioned in said housing, said vibrator having a motor and a shaft operationally coupled to and extending from said motor, said shaft being positioned in said housing;

a plurality of adapters, each said adapter being selectively couplable to said housing and interchangeably couplable to said housing and said vibrator whereby said adapter vibrates when said vibrator is activated, each said adapter having a distal end relative to said housing, said distal end of each said adapter being configured for coupling to a razor blade cartridge, said distal end of each adapter further being uniquely configured for coupling to one of a plurality of different razor blade cartridge connectors;

a socket coupled to said housing, said socket having a first end coupled to a selectable one of said adapters, each said adapter having a rod inserted into said socket whereby said adapter is coupled to said socket;

a seal coupled between said socket and said housing;

a projection coupled to and extending outwardly from said rod of said adapter;

an indentation extending into an interior wall of said socket, said indentation receiving said projection when said rod of said adapter is inserted into said socket, said projection being complimentary to said indentation;

a vibrator switch coupled to said housing, said vibrator switch being operationally coupled to said vibrator for selectively activating said vibrator, said vibrator switch being operationally coupled to said vibrator for adjusting a vibration speed of said vibrator;

a dampener having a first end engaging said socket and a second end receiving said shaft of said vibrator; and a gasket coupled to said socket, said gasket being positioned between said dampener and said socket;

a storage unit having a bottom and a sidewall extending upwardly from a perimeter edge of said bottom defining an interior space;

an ultraviolet light source coupled to and positioned in said interior space of said storage unit, said housing being positionable in said interior space whereby said ultraviolet light is configured for positioning adjacent to a razor blade of the razor blade cartridge;

a light switch coupled to said storage unit, said light switch being operationally coupled to said ultraviolet light source for selectively activating said ultraviolet light source;

a first compartment positioned in said interior space, said plurality of adapters being positionable in said first compartment;

a first lid coupled to said storage unit, said first lid selectively covering said first compartment;

a second compartment positioned in said interior space; and a second lid coupled to said storage unit, said second lid selectively covering said second compartment.

* * * * *